US006520757B1

(12) United States Patent
Erdmann et al.

(10) Patent No.: US 6,520,757 B1
(45) Date of Patent: Feb. 18, 2003

(54) HOUSING FOR ACCOMMODATING A MICROPUMP

(75) Inventors: Sven Erdmann, Ulm (DE); Gerald Voegele, Sindelfingen (DE); Thomas Weisener, Ditzingen (DE)

(73) Assignee: HNP Mikrosysteme GmbH, Parchim (DE)

( * ) Notice: Subject to any disclaimer, the term of this patent is extended or adjusted under 35 U.S.C. 154(b) by 0 days.

(21) Appl. No.: 09/787,699

(22) PCT Filed: Sep. 21, 1999

(86) PCT No.: PCT/EP99/06959

§ 371 (c)(1),
(2), (4) Date: Mar. 20, 2001

(87) PCT Pub. No.: WO00/17523

PCT Pub. Date: Mar. 30, 2000

(30) Foreign Application Priority Data

Sep. 21, 1998 (DE) ..... 198 43 161

(51) Int. Cl.[7] ..... F04C 2/10
(52) U.S. Cl. ..... 418/171; 418/39
(58) Field of Search ..... 418/39, 166, 170, 418/171, 270

(56) References Cited

U.S. PATENT DOCUMENTS

| | | | | |
|---|---|---|---|---|
| 2,655,108 A | * | 10/1953 | Osborne | 418/39 |
| 2,956,512 A | * | 10/1960 | Brundage | 418/171 |
| 3,799,201 A | | 3/1974 | Hansen et al. | 418/61.3 |
| 4,344,746 A | * | 8/1982 | Leonard | 418/270 |
| 4,697,997 A | * | 10/1987 | White, Jr. | 418/270 |
| 5,797,734 A | * | 8/1998 | Kizer et al. | 418/171 |

FOREIGN PATENT DOCUMENTS

| | | |
|---|---|---|
| CH | 661 323 | 7/1987 |
| WO | WO 97/12147 | 4/1997 |

OTHER PUBLICATIONS

Datenblatt Pumpenkopf mzr–4600 published by Hydraulic Nord Parchim Datenblatt MZR4600.DOC Nov. 8, 1997.

* cited by examiner

*Primary Examiner*—John J. Vrablik
(74) *Attorney, Agent, or Firm*—Herbert Dubno

(57) ABSTRACT

A housing for a micro pump or like micro system has at least three structured elements which are layered and which respectively form a support plate, a connecting block and a base element with a further plate-shaped layered structure element located between the connecting block and the support plate and serving with the axially oriented or circumferentially-oriented channel section for conveying fluid between the connecting block and the support plate.

6 Claims, 9 Drawing Sheets

HOUSING FOR ACCOMMODATING A MICROPUMP

BACKGROUND OF THE INVENTION

The invention relates to a housing construction for receiving or accommodating and supporting a micro pump conveying for example a fluid, the micro pump working according to the principle described in WO-A 97/12147; as far as the operation method of this type of pump or of a corresponding type of a fluidic motor is concerned, reference is explicitly made to this document, particularly to page 1 (paragraph 2), page 5 (paragraph 4) and page 6 (last paragraph) as well as page 7 (first paragraph). An inner wheel and an outer wheel are designed and arranged to be in a meshing engagement with each other, both, the inner wheel and said outer wheel being rotatably arranged in a sleeve, compare FIGS. 1, 1*a*, 2 and 2*a*, as well as FIGS. 3*a*, 3*b* and 3*c* of this document. The inner wheel is coupled with a shaft (50) to be stiff against torsion. An axis of the outer wheel and of the sleeve is offset relative to an axis of the shaft, so that the inner wheel with its outward oriented teeth rolls on an inward oriented, smooth, particularly cycloid tooth structure of the outer wheel, and axial sealing lines are provided depending on the number of teeth, respective pairs of said sealing lines defining a conveying chamber. In a pump arrangement, the conveying chambers enlarge in a direction of rotation on a suction side, take up a fluid and convey it to a delivery side over an imagined center plane extending through an axis, on which delivery side the conveying chamber, which just passed over, continuously decreases in the course of a continued rotation until it is practically zero, and returned to the suction side on an opposite side of the center plane. On the suction side, the pump chamber starts to open again continuously with the rotary movement, so that the cycle is concluded. The movement described for one conveying chamber is simultaneously valid for all existing conveying chambers which at an instant have a different volume between a respective pair if sealing lines, so that, upon operating the pump, a fluid current of a maximum uniformity together with a high ability of miniaturization of the entire micro system construction is achieved.

A high miniaturization requires that fluidic micro systems, which are e. g. designed as pumps, are correspondingly supported or arranged. Thus, in the described prior art according to WO-A 97/12147, a sleeve is selected as a bearing, in which sleeve parts (41, 42) are inserted on both face ends of the inner wheel and the outer wheel, the parts serving for supporting the shaft and for determining an inlet kidney and an outlet kidney (specifically described in FIG. 8 of the document with reference to an inlet kidney 41k and an outlet kidney 42k). The inlet kidney is offset (reflected) at an angle of 180° relative to the outlet kidney, but on two opposite ends, so that an axial fluid current is obtained from the inlet kidney to the outlet kidney over the conveying chambers continuously changing in volume according to the above mentioned description. However, such a pump may also operate with a U-shaped fluid current, the inlet kidney and the outlet kidney in this case being arranged at the same face end of the pump, only offset to be mirror-inverted at an angle of 180° relative to each other (reflected at a center plane extending through an axis). Such a micro system can be inserted or insertable in a housing construction such that it is safely and exactly supported, but that simultaneously all connections are provided for permitting a fluid inlet, a fluid outlet and a coupling of a mechanical driving source for rotating a pump shaft (of an inner wheel pump or an outer wheel pump) or an output or delivery drive shaft (of a fluidic motor) or a measurement technical aspect (of a fluidic sensor) for the flow of a volume.

A suitable housing shape for accommodating such a micro pump is described in a data sheet "Pumpenkopf mzr®-4600" by Hydraulik Nord Parchim Mikrosysteme GmbH. The pump head described in this document is provided with a shaft protruding at a face end four coupling a motor. This housing construction comprises five disc-shaped elements adapted as cylindrical elements, starting with a housing-shaft sealing, a compensating kidney plate and a rotor support plate, followed by a fluid guiding means and a terminal end cover. The rotor support has a thickness (or height or size extending in an axial direction) corresponding to an axial dimension of the outer wheel and the inner wheel according to the above mentioned description. The support plate is provided with an opening offset relative to the shaft axis for eccentrically driving the inner wheel, so that the outer wheel of the toothed ring micro pump is supported eccentrically in the opening of the plate and realizes the above described operating method of conveying chambers continuously increasing in volume and on an opposite side continuously decreasing in volume—when the shaft is driven by a rotating drive. On both sides of the outer wheel and the inner wheel, thus in a direct contact with the wheels at a face end respectively, the compensating kidney plate and the fluid guiding plate are arranged, the plates comprising the above described inlet kidney and outlet kidney on a fluid supplying side and oriented towards the rotor, and compensating kidneys arranged to be reflected symmetrically with respect thereto for providing a hydraulic balance on an opposite side. Thus, a U-shaped fluid current is obtained extending from an inlet over the inlet kidney to the rotating pump chambers, towards an outlet and back to a radially oriented outlet as shown in the data sheet mzr®-4600.

DE-B 33 10 593 (White) shows a housing construction for a pump arrangement (FIG. 1, reference numeral 22) according to which an eccentrically operating gerotor together with an eccentrically operating wobble rod is realized. At an end through which the shaft does not pass, a central outlet and an inlet radially offset with respect to the outlet are provided, a number of intermediate plates provided with channel segments being arranged between the inlet and the outlet (compare FIGS. 2, 3, 4 and 5 of the document). DE-A 24 08 824 (McDermott, compare FIG. 4) works with only three plate shaped elements; the last mentioned illustration shows the gerotor principle in connection with a compensation of wear aspects of teeth being in a meshing engagement, whereby channel segments are provided in a directly adjacent portion between an inner plate and two outer support plates for the shaft. CH-A 661 323 (Weber) also relates to channel segments in a housing construction comprising a number of plates, the document in a modular construction manner assembling a toothed wheel pump from a number of components easy to combine, to replace and to supplement, but actually describing a housing for accommodating such a pump.

OBJECT OF THE INVENTION

It is an object of the invention to improve a housing construction such that the flexibility of the housing construction is increased and that it is not necessary to separately manufacture each of the described plate-shaped elements for each individual application.

SUMMARY OF THE INVENTION

According to the invention the object is achieved by arranging at least one and preferably two or more plate-shaped layered structure elements between a support plate for receiving or accommodating an outer element of a micro system and a connecting block for mounting inlet and outlet means, with which elements a fluid conveyance or transport in the layered structure elements, i. e. from an inlet to the micro system in the support plate (inlet channel) and back to an outlet (outlet channel), is improved and made more flexible.

At least one further plate-shaped layered structure element comprises one, two or more channel segments oriented either substantially radially, circumferentially or axially. Only axially oriented channel segments may be provided, but also only substantially radially oriented segments may be provided, as well as a combination of both channel segments provides an optional fluid guiding without requiring a modification of the support plate and without requiring an adaptation of the connecting block and its fluid supply. An adaptation is effected over at least one further plate-shaped layered structure element, thus providing a higher flexibility of the existing standard components for a fluid supply or the support plate.

The invention realizes that certain precision parts have to be used only at positions at which they are required, whereas other layered structure elements of the housing construction may be standard components; thus, for example, the connecting block for connecting flexible tubes may be a standard component not requiring a particular precision, on the contrary, a support plate for a rotor has to be provided as a precision part, and also the plate-shaped layered structure elements which are adjacent to the support plate and are provided as one of the further plate-shaped layered structure elements and one additional plate-shaped layered structure element. The two neighbored plates with respect to the support plate for e. g. a micro pump carry kidneys as described in detail before, an inlet kidney and an outlet kidney being located in one of the plates and compensating kidneys being mirror-image located in the other of the plates.

Actually, the kidneys are channel segments which have a circumferential curved extension, which may also have a uniform width, and in which a fluid is conveyed. Simultaneously, the kidneys have a continuous axial design in the "kidney plate" on one side and in the axially symmetrical "kidney plate" on another side of the support plate for the micro system, the kidneys having their ends at a surface of the corresponding plate or at a surface of a further plate then covering the first plate of the layered structure assembly of the housing.

Thus, two separate channels may be provided, one channel system for supplying a fluid to a micro system and a second channel system for delivering a fluid from said micro system on an outlet side (e. g. a delivery side of said micro pump), said second channel system being circumferentially offset with respect to said first channel system and mounted in said plate-shaped layered structure element. Each of said channel systems leads away from a mounting position for said micro system, e. g. said pump, both in an axial and a radial outward direction to said connecting block for mounting said inlet and outlet connections, said mounting position being located far in the center of said housing construction. Preferably, said one further plate comprises a radial and an axial channel segment in said first channel system and in said second channel system. Therefore, in one single plate-shaped element, the fluid current may strongly be offset in a radial direction to allow the use of thicker connecting means, but nevertheless to provide a shaft in a shaft support on both sides of said support plate accommodating said micro system. Thus, the shaft opening extends on both sides of said support plate, and said shaft is supported on both sides of said micro system.

The micro pump is referred to as an example. The housing construction is similarly suited for accommodating other micro systems, such as a micro motor driven by a fluid, which micro motor is driven by supplying a fluid current, and in which micro motor a delivery shaft delivers at a speed corresponding to the fluid current. A sensor having a fluid drive may also be used as a micro system, said sensor being arranged in said housing construction and measuring a fluid current, a shaft not having to extend completely out of said housing, but only being provided as a shaft end for supporting a rotor, a speed corresponding to said fluid current being scanned by optical, inductive or magnetic means. Therefore, the proposed housing has a versatile field of application for practically all micro systems working with a fluid flow rate, said micro systems being represented according to the invention by a pump, a motor and a sensor.

Axial channel segments in an additional plate-shaped layered structure element arranged directly adjacent to said support plate for said micro system may have a particular design. When their length is smaller than a height (or thickness or size) of said layered structure element, said continuous axial kidney is coupled to be laterally offset, when the diameter of said axial channel segment is larger than a maximum width of said kidney at said coupling position. A total volume of said fluid collected in said continuous axial kidney may thus be delivered easily and without flow difficulties, a flow cross-section of an opening being recommended to be selected such that it substantially corresponds to a cross-section of said kidney at a position of a maximum flow volume, which cross-section in an operation mode is interspersed by said fluid to be conveyed through said channel segments.

A maximum flow volume (volume per time) exists on both sides (suction side/delivery side) of a pump or a motor and is not constant in case of a circumferentially extending kidney, which is due to the manner of volume change of a respective conveying chamber during a rotary movement. When the axial channel segment in the further plate-shaped layered structure element is provided at a circumferential position of said kidney, particularly continuously changing its width, the supplied fluid and the delivered fluid may be axially displaced exactly to a position at which said maximum flow volume is obtained in the course of said circumferentially extending kidney. In an axial top plan view of a pump rotating clockwise, said maximum flow volume is located in a first and a second quadrant, in said first quadrant at an angle between 75° and 85°, particularly substantially between 80° and 85° and correspondingly axially symmetrical in said second quadrant.

A design of a radially oriented, elongated opening through said further layered-structure element between said connecting block and said first further layered structure element comprising said kidneys is obtained by combining an axial and a substantially radial channel segment, said radial channel segment having a depth oriented in an axial direction, said depth corresponding to an axial extension of a second or further) layered structure element. Said channel segment provides a displacing function for said fluid current leading from portions close to an axis to radially more outward portions, where two adjacent connections for supplying and delivering a fluid may be arranged in said connecting block without problems.

According to the invention, slant openings or channel segments having a skew or slant orientation relative to an axis may be avoided in said layered elements. The channel segments according to the invention have a radial, circumferential or axial extension or an optional combination thereof, so that described by cylindrical coordinates, each position in said housing construction is within reach, combined by an axial channel segment, circumferential channel segment or radial channel segment respectively required. By selecting specific plates comprising corresponding channel segments, connections between standard components may be obtained without designing a whole micro system with its housing. Only layers of a layered structure construction, which layers have to be designed differently, are newly designed while maintaining the remaining layers.

The complete layered structure of said housing is axially tightened together, e. g. by center pins and/or cylinder screws inserted at an end part, at which also a mounting position is provided for a micro pump accommodated in said housing. On another axial side of said housing, connections for supplying and delivering a fluid are provided, said connections having either a radial or and axial orientation depending on the design of said connecting block.

The invention

- provides a fluid transition from connecting means having relatively large dimensions to a miniaturized fluidic operational range of a micro system, such as a micro pump;
- realizes a miniaturized manufacturing of toothed ring micro systems;
- provides a flexible fluid conveyance in a layer structure (from a connection to a rotor), which structure is easy to manufacture;
- provides a flexible design of a "connecting block" housing component for supporting different connecting means or fluid connections varying in their position;
- provides a representation of flow cross-sections in structures having a 2 ½ dimensional extension, such as they may be provided for instance by LIGA, wire erosion, precision blanking, etching, laser, etc.;
- allows expendable parts, such as bearings, to be exchanged;
- allows a batch processing of a number of parts simultaneously;
- allows the use of an identical semi-finished product (basic material) for all operational ranges;
- allows a direct piling of a number of rotor sets.

A particularly favorable coupling embodiment for mounting a housing construction at a driving source, such as a feed-forward or feed-backward controlled drive, is realized by a coupling housing, on one side of which said housing construction with said micro pump and on the other side of which a drive assembly are mounted. Both said drive assembly and said housing construction for the micro pump are provided with a protruding collar, said collars preferably not having equal dimensions to avoid confusion of the different sides. Said collar engages in a recess exactly adapted to said collar, said two recesses in said coupling housing being exactly aligned in an axial direction relative to each other. When said pump and said drive assembly are mounted with their exactly fitting collars from both axial sides of said coupling housing, it can be guaranteed that the shafts are in an axial alignment and remain connected in said axial alignment over an adapter. Thereby, a radial offset of said shafts may be avoided; assembling is favored and accelerated. Said coupling housing may be covered by a sleeve having an outer polygonal, particularly a tetragonal or a octagonal design, from which sleeve a motor and a pump protrude on both face ends. Said coupling may also be used for other combinations of fluidic micro systems.

Thus, the invention provides clearness, easily manufacturable individual parts, facilitates manufacturing, and increases assembling flexibility and exactness. Only necessary layered structure elements have to be precision manufactured, whereas other, uncritical layered structure elements may remain as standard components. It is particularly pointed out that said layered structure elements, when they are plate-shaped, may preferably have an equal thickness (a height measured in an axial direction) and may therefore be manufactured as semi-finished products from the same plate material. The same semi-finished produce serves as a basic product for a number of layered structure elements which are arranged axially one after the other and all have equal quality features of the basic plate. A different evenness and surface quality of said basic plate is thus transferred directly to the layered structure elements manufactured from said plate and predetermine which semi-finished product should be used for which precision parts and which other semi-finished product should be used for the standard elements of the layered structure. Therefore, manufacturing costs may be reduced, an after-treatment of said precision parts being avoided and a semi-finished product involving a high cost not having to be used for all layered structure elements, which avoided methods would have resulted in an increase in the cost of the manufactured housing construction. In addition to said cost reduction, an exact fluid conveyance in said micro pump and a sealing between the individual layered structure elements as well as an exact fluid conveyance in said inlet kidneys, said outlet kidneys and said compensating kidneys are provided, said features determining the performance and the efficiency of said micro pump.

An elongated axial opening is called "shaft opening" for supporting said shaft, when mounting a micro system. Said opening is elongated, it extends continuously through a support plate and in both axial directions of said housing construction, said opening extending at least through said further plate-shaped layered structure, said support plate and said connecting block or said base element, at least reaching into to extend "continuously". Two layered structure elements with their shaft opening portion, may serve as bearings for said shaft with a slide bearing, said elements being directly adjacent to said support plate (for said micro system). Depending on the length of said axis, an additional bearing may be provided in said base element, said bearing being designed as a rolling bearing or a slide bearing, for additionally supporting said shaft in a portion located between said supply side and said delivery side (in case of a pump and a motor or in case of a fluidic motor and a drive). Said shaft may thus be stabilized in said slide bearings, thereby increasing the service life of said bearings. In said connecting block, a shaft safety device may be provided, said device blocking an axial movement of said shaft. Said safety device is not required, when said additional bearing in said base element is provided; in this case, said shaft is not required to protrude into said connecting block, but it may terminate before, which is correspondingly valid for the shaft opening of the housing.

The above used terms of an extension in an axial direction, in a radial direction and in a circumferential direction are oriented at cylindrical coordinates, however, a plate-shaped layered structure assembly has not necessarily a cylindrical outer shape, on the contrary, also a polygonal, such as a tetragonal, a hexagonal or an octagonal outer shape, as well as not circular shapes, such as oval shapes, are comprised by the invention. Also a radial extension has to be regarded as only substantially radial. The use of the technical term "circumferential" extension serves to facilitate comprehension, but not to restrict the realization of the invention. In the same manner, the terms "disc" and "plate" are used such that they describe a flat shape without a specifically defined outer dimension or outer shape, although it is advantageous to select a cylindrical shape being oriented at the cylindrical shape of said outer wheel of the micro pump, however this is not imperative.

SPECIFIC DESCRIPTION

It is pointed out that the terms of an additional layered structure element and of a further (first and second further) layered structure element are used uniformly. A basic layered structure element defining a concept is a support plate for receiving or accommodating a micro system as an inner plate, and a connecting block 11 on one side and a plate-shaped base element 12 on the other side. Said connecting block and said plate-shaped base element are not required to be directly plate-shaped, they may also be designed individually longer in an axial direction, to form unilateral or bilateral block structures.

Figures 1, 2A:
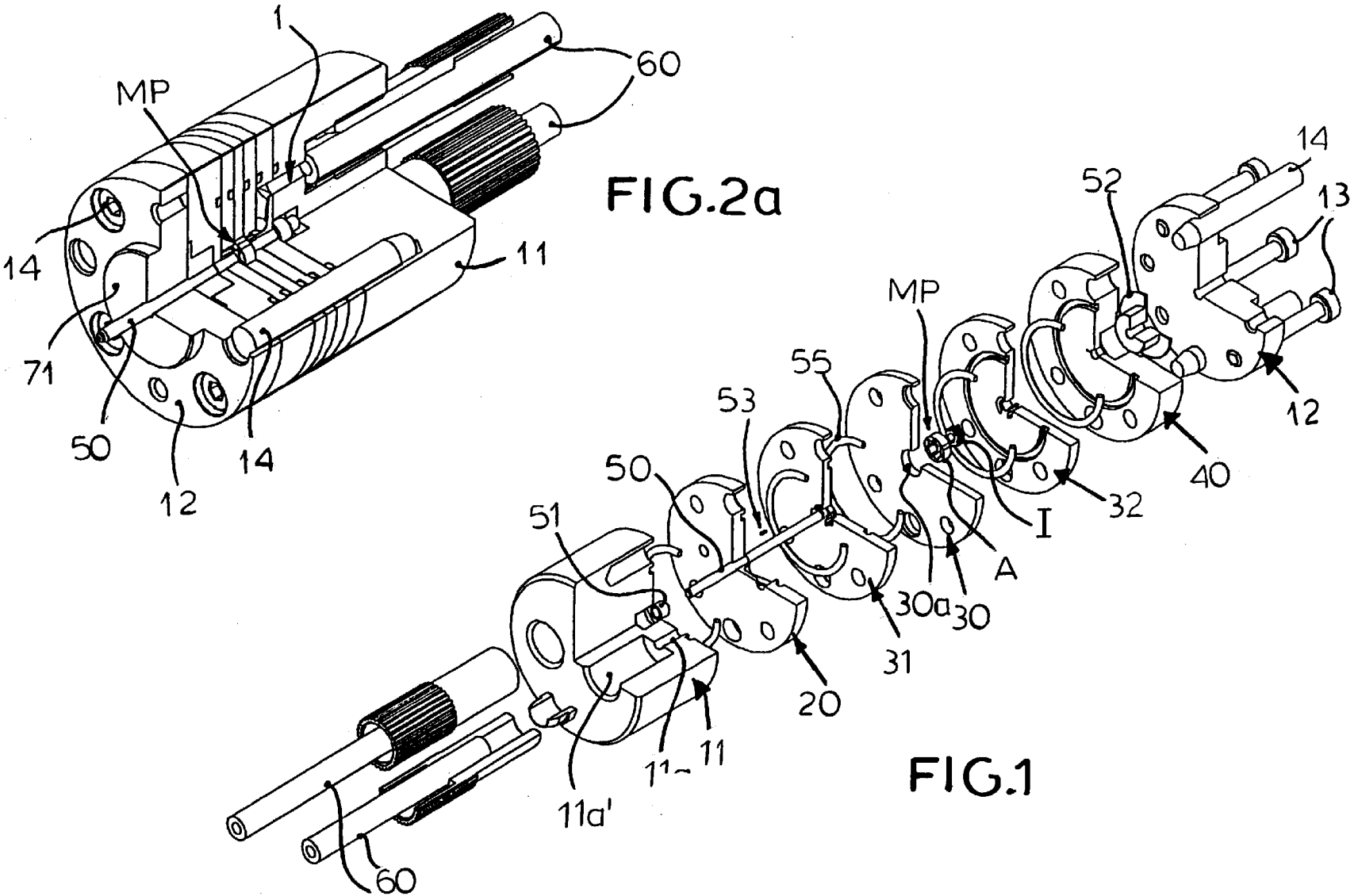
FIG. 1 is an exploded view of an embodiment of the invention, illustrating a micro pump MP centrally accommodated in a housing, said micro pump being supported by a number of layered structure elements which are represented here as cylindrical discs.
FIG. 2*a* is an illustration similar to that of FIG. 2 showing that embodiment, the micro pump in the center of said housing being visible more clearly.

Between a support plate 30 of FIG. 1 and a connecting block 11, two "further" plate structures 20,31 are provided. Between said support plate 30 and a plate shaped base element 12 of FIG. 1 two "additional" plate-shaped elements 32,40 are provided which elements realize respective independent functions. Said "further" plates shall be oriented uniformly to a side on which said connecting block 11 is located; said "additional" plates shall be oriented uniformly terminologically to a side directing to said plate-shaped base element 12.

A micro system, which in the following embodiment is designated as a micro pump MP, has a structure schematically illustrated in FIG. 1 and comprising an outlet wheel a and an inner wheel I, said inner wheel with its teeth protruding in an outward direction being in a meshing engagement with said outer wheel A which is also rotatbly supported in an opening 30*a* of said outer plate 30. A rotary movement is transferred.

What is claimed is:

1. A housing construction for receiving or accommodating and supporting a micro pump conveying a fluid and comprising an outer wheel toothed towards an inside and an inner wheel toothed towards an outside and being in a meshing engagement with said outer wheel, said inner wheel being in a nonrotating engagement with an elongated axial shaft, said housing construction comprising:

(a) an elongated axial opening for receiving or accommodating said shaft of said micro pump, said opening defining a housing axis;

(b) at least three layered structure elements extending in a perpendicular direction with respect to said housing axis, wherein (aa) one of said elements is provided as a support plate having a recess extending in an axial direction, for rotatably supporting said outer wheel, (bb) one of said elements is provided as a connecting block for mounting at least one inlet and one outlet for supplying and delivering said fluid, and (cc) one of said elements being provided as a base element for receiving axially oriented mounting or clamping means for the other layered structure elements;

(c) a further plate-shaped layered structure element located between said connecting block and said support plate and comprising one of axially oriented channel segments, circumferentially oriented channel segments and radially oriented channel segments or an optional combination thereof for conveying said fluid from connections of said connecting block to a recess of said support plate for said micro pump, said circumferentially oriented channel segments in said further plate-shaped layered structure element being designed as kidneys axially open towards the surface of the adjacent layered structure elements to directly adjoin a face end of said outer and inner wheels of said micro pump, when it is supported in said recess of said support plate.

2. The housing construction according to claim 1 wherein said further plate-shaped layered structure element has a thickness and is provided with at least one axial channel segment which is radially offset in relation to the corresponding kidney and has a length which is smaller than the thickness of said further plate-shaped element.

3. A housing construction for receiving or accommodating and supporting a micro pump conveying a fluid and comprising an outer wheel toothed towards an inside and an inner wheel toothed towards an outside and being in a meshing engagement with said outer wheel, said inner wheel being in a nonrotating engagement with an elongated axial shaft, said housing construction comprising:

(a) an elongated axial opening for receiving or accommodating said shaft of said micro pump, said opening defining a housing axis;

(b) at least three layered structure elements extending in a perpendicular direction with respect to said housing axis, wherein (aa) one of said elements is provided as a support plate having a recess extending in an axial direction, for rotatably supporting said outer wheel, (bb) one of said elements is provided as a connecting block for mounting at least one inlet and one outlet for supplying and delivering said fluid, and (cc) one of said elements being provided as a base element for receiving axially oriented mounting or clamping means for the other layered structure elements;

(c) a further plate-shaped layered structure element located between said connecting block and said support plate and comprising one of axially oriented channel segments, circumferentially oriented channel segments and radially oriented channel segments or an optional combination thereof for conveying said fluid from connections of said connecting block to a recess of said support plate for said micro pump, at least one additional plate-shaped layered structure element being located between said support plate for the micro pump and said base element for receiving mounting or clamping means, and at least two plate-shaped layered structure elements are located between said support plate and said connecting block, said elements being adapted to be tightened together in an axial direction and fixed in relation to each other by said mounting or clamping means.

4. A housing construction for receiving or accommodating and supporting a micro pump conveying a fluid and comprising an outer wheel toothed towards an inside and an inner wheel toothed towards an outside and being in a meshing engagement with said outer wheel, said inner wheel being in a nonrotating engagement with an elongated axial shaft, said housing construction comprising:

(a) an elongated axial opening for receiving or accommodating said shaft of said micro pump, said opening defining a housing axis;

(b) at least three layered structure elements extending in a perpendicular direction with respect to said housing axis, wherein (aa) one of said elements is provided as a support plate having a recess extending in an axial direction, for rotatably supporting said outer wheel, (bb) one of said elements is provided as a connecting block for mounting at least one inlet and one outlet for supplying and delivering said fluid, and (cc) one of said elements being provided as a base element for receiving axially oriented mounting or clamping means for the other layered structure elements;

(c) a further plate-shaped layered structure element located between said connecting block and said support plate and comprising one of axially oriented channel segments, circumferentially oriented channel segments and radially oriented channel segments or an optional combination thereof for conveying said fluid from connections of said connecting block to a recess of said support plate for said micro pump, at least one of said axially, circumferentially and radially oriented channel segments forming a continuous first channel extending from said inlet to said recess for the micro pump for supplying fluid, and a further circumferentially offset channel in said layered structure elements, for delivering a fluid from said recess to said outlet, said inlet channel and said outlet channel having a substantially constant cross section throughout their lengths betweens said connecting block and said support plate.

5. A housing construction for receiving or accommodating and supporting a micro pump conveying a fluid and comprising an outer wheel toothed towards an inside and an inner wheel toothed towards an outside and being in a meshing engagement with said outer wheel, said inner wheel being in a nonrotating engagement with an elongated axial shaft, said housing construction comprising:

(a) an elongated axial opening for receiving or accommodating said shaft of said micro pump, said opening defining a housing axis;

(b) at least three layered structure elements extending in a perpendicular direction with respect to said housing axis, wherein (aa) one of said elements is provided as a support plate having a recess extending in an axial direction, for rotatably supporting said outer wheel, (bb) one of said elements is provided as a connecting block for mounting at least one inlet and one outlet for supplying and delivering said fluid, and (cc) one of said elements being provided as a base element for receiving axially oriented mounting or clamping means for the other layered structure elements;

(c) a further plate-shaped layered structure element located between said connecting block and said support plate and comprising one of axially oriented channel segments, circumferentially oriented channel segments and radially oriented channel segments or an optional combination thereof for conveying said fluid from connections of said connecting block to a recess of said support plate for said micro pump, two plate-shaped layered structure elements for supporting said shaft being provided inside said shaft opening for rotatably supporting said shaft, said two of said elements directly contacting said support plate on opposite sides.

6. A housing construction for receiving or accommodating and supporting a micro pump conveying a fluid and comprising an outer wheel toothed towards an inside and an inner wheel toothed towards an outside and being in a meshing engagement with said outer wheel, said inner wheel being in a nonrotating engagement with an elongated axial shaft, said housing construction comprising:

(a) an elongated axial opening for receiving or accommodating said shaft of said micro pump, said opening defining a housing axis;

(b) at least three layered structure elements extending in a perpendicular direction with respect to said housing axis, wherein (aa) one of said elements is provided as a support plate having a recess extending in an axial direction, for rotatably supporting said outer wheel, (bb) one of said elements is provided as a connecting block for mounting at least one inlet and one outlet for supplying and delivering said fluid, and (cc) one of said elements being provided as a base element for receiving axially oriented mounting or clamping means for the other layered structure elements;

(c) a further plate-shaped layered structure element located between said connecting block and said support plate and comprising one of axially oriented channel segments, circumferentially oriented channel segments and radially oriented channel segments or an optional combination thereof for conveying said fluid from connections of said connecting block to a recess of said support plate for said micro pump, a combination of a substantially radially oriented channel segment and an axial channel segment together forming a substantially radially oriented longitudinal opening, an axial height of which corresponds to the layer thickness of said plate-shaped layered structure element.

* * * * *

UNITED STATES PATENT AND TRADEMARK OFFICE

CERTIFICATE OF CORRECTION

PATENT NO. : 6,520,757 B1 
DATED : February 18, 2003
INVENTOR(S) : Sven Erdmann et al.

It is certified that error appears in the above-identified patent and that said Letters Patent is hereby corrected as shown below:

Delete pages 1-10 of specification and substitute pages 1-20 and replace pages 11-18 to be renumbered pages 21-28

Signed and Sealed this

Eighth Day of March, 2005

JON W. DUDAS
*Director of the United States Patent and Trademark Office*

*HOUSING FOR ACCOMMODATING A MICROPUMP*

SPECIFICATION

BACKGROUND OF THE INVENTION

The invention relates to a housing construction for receiving or accommodating and supporting a micro pump conveying for example a fluid, the micro pump working according to the principle described in WO-A 97/12147; as far as the operation method of this type of pump or of a corresponding type of a fluidic motor is concerned, reference is explicitly made to this document, particularly to page 1 (paragraph 2), page 5 (paragraph 4) and page 6 (last paragraph) as well as page 7 (first paragraph). An inner wheel and an outer wheel are designed and arranged to be in a meshing engagement with each other, both, the inner wheel and said outer wheel being rotatably arranged in a sleeve, compare figures 1, 1a, 2 and 2a, as well as figures 3a, 3b and 3c of this document. The inner wheel is coupled with a shaft (50) to be stiff against torsion. An axis of the outer wheel and of the sleeve is offset relative to an axis of the shaft, so that the inner wheel with its outward oriented teeth rolls on an inward oriented, smooth, particularly cycloid tooth structure of the outer wheel, and axial sealing lines are provided depending on the number of teeth, respective pairs of said sealing lines defining a conveying chamber. In a pump arrangement, the conveying chambers enlarge in a direction of rotation on a suction side, take up a fluid and convey it to a delivery side over an imagined center plane extending through an axis, on which delivery side the conveying chamber, which just passed over, continuously decreases in the course of a continued rotation until it is practically zero, and returned to the suction side on an opposite side of the center plane. On the suction side, the pump chamber starts to open again continuously with the rotary movement, so that the cycle is concluded. The movement described for one conveying chamber is simultaneously valid for all existing conveying chambers which at an instant have a different volume between a respective pair if sealing lines, so that, upon operating the pump, a fluid current of a maximum uniformity together with a high ability of miniaturization of the entire micro system construction is achieved.

A high miniaturization requires that fluidic micro systems, which are e. g. designed as pumps, are correspondingly supported or arranged. Thus, in the described prior art according to WO-A 97/12147, a sleeve is selected as a bearing, in which sleeve parts (41, 42) are inserted on both face ends of the inner wheel and the outer wheel, the parts serving for supporting the shaft and for determining an inlet kidney and an outlet kidney (specifically described in figure 8 of the document with reference to an inlet kidney 41k and an outlet kidney 42k). The inlet kidney is offset (reflected) at an angle of 180° relative to the outlet kidney, but on two opposite ends, so that an axial fluid current is obtained from the inlet kidney to the outlet kidney over the conveying chambers continuously changing in volume according to the above mentioned description. However, such a pump may also operate with a U-shaped fluid current, the inlet kidney and the outlet kidney in this case being arranged at the same face end of the pump, only offset to be mirror-inverted at an angle of 180° relative to each other (reflected at a center plane extending through an axis). Such a micro system can be inserted or insertable in a housing construction such that it is safely and exactly supported, but that simultaneously all connections are provided for permitting a fluid inlet, a fluid outlet and a coupling of a mechanical driving source for rotating a pump shaft (of an inner wheel pump or an outer wheel pump) or an output or delivery drive shaft (of a fluidic motor) or a measurement technical aspect (of a fluidic sensor) for the flow of a volume.

A suitable housing shape for accommodating such a micro pump is described in a data sheet "Pumpenkopf mzr®-4600" by Hydraulik Nord Parchim Mikrosysteme GmbH. The pump head described in this document is provided with a shaft protruding at a face end four coupling a motor. This housing construction comprises five disc-shaped elements adapted as cylindrical elements, starting with a housing-shaft sealing, a compensating kidney plate and a rotor support plate, followed by a fluid guiding means and a terminal end cover. The rotor support has a thickness (or height or size extending in an axial direction) corresponding to an axial dimension of the outer wheel and the inner wheel according to the above mentioned description. The support plate is provided with an opening offset relative to the shaft axis for eccentrically driving the inner wheel, so that the outer wheel of the toothed ring micro pump is supported eccentrically in the opening of the plate and realizes the above described operating method of conveying chambers continuously increasing in volume and on an opposite side continuously decreasing in volume - when the shaft is driven by a rotating drive. On both sides of the outer wheel and the inner wheel, thus in a direct contact with the wheels at a face end respectively, the compensating kidney plate and the fluid guiding plate are arranged, the plates comprising the above described inlet kidney and outlet kidney on a fluid supplying side and oriented towards the rotor, and compensating kidneys arranged to be reflected symmetrically with respect thereto for providing a hydraulic balance on an opposite side. Thus, a U-shaped fluid current is obtained extending from an inlet over the inlet kidney to the rotating pump chambers, towards an outlet and back to a radially oriented outlet as shown in the data sheet mzr®-4600.

DE-B 33 10 593 (White) shows a housing construction for a pump arrangement (figure 1, reference numeral 22) according to which an eccentrically operating gerotor together with an eccentrically operating wobble rod is realized. At an end through which the shaft does not pass, a central outlet and an inlet radially offset with respect to the outlet are provided, a number of intermediate plates provided with channel segments being arranged between the inlet and the outlet (compare figures 2, 3, 4 and 5 of the document). DE-A 24 08 824 (McDermott, compare figure 4) works with only three plate shaped elements; the last mentioned illustration shows the gerotor principle in connection with a compensation of wear aspects of teeth being in a meshing engagement, whereby channel segments are provided in a directly adjacent portion between an inner plate and two outer support plates for the shaft. CH-A 661 323 (Weber) also relates to channel segments in a housing construction comprising a number of plates, the document in a modular construction manner assembling a toothed wheel pump from a number of components easy to combine, to replace and to supplement, but actually describing a housing for accommodating such a pump.

OBJECT OF THE INVENTION

It is an object of the invention to improve a housing construction such that the flexibility of the housing construction is increased and that it is not necessary to separately manufacture each of the described plate-shaped elements for each individual application.

SUMMARY OF THE INVENTION

According to the invention the object is achieved by arranging at least one and preferably two or more plate-shaped layered structure elements between a support plate for receiving or accommodating an outer element of a micro system and a connecting block for mounting inlet and outlet means, with which elements a fluid conveyance or transport in the layered structure elements, i. e. from an inlet to the micro system in the support plate (inlet channel) and back to an outlet (outlet channel), is improved and made more flexible.

At least one further plate-shaped layered structure element comprises one, two or more channel segments oriented either substantially radially, circumferentially or axially. Only axially oriented channel segments may be provided, but also only substantially radially oriented segments may be provided, as well as a combination of both channel segments provides an optional fluid guiding without requiring a modification of the support plate and without requiring an adaptation of the connecting block and its fluid supply. An adaptation is effected over at least one further plate-shaped layered structure element, thus providing a higher flexibility of the existing standard components for a fluid supply or the support plate.

The invention realizes that certain precision parts have to be used only at positions at which they are required, whereas other layered structure elements of the housing construction may be standard components; thus, for example, the connecting block for connecting flexible tubes may be a standard component not requiring a particular precision, on the contrary, a support plate for a rotor has to be provided as a precision part, and also the plate-shaped layered structure elements which are adjacent to the support plate and are provided as one of the further plate-shaped layered structure elements and one additional plate-shaped layered structure element. The two neighbored plates with respect to the support plate for e. g. a micro pump carry kidneys as described in detail before, an inlet kidney and an outlet kidney being located in one of the plates and compensating kidneys being mirror-image located in the other of the plates.

Actually, the kidneys are channel segments which have a circumferential curved extension, which may also have a uniform width, and in which a fluid is conveyed. Simultaneously, the kidneys have a continuous axial design in the "kidney plate" on one side and in the axially symmetrical "kidney plate" on another side of the support plate for the micro system, the kidneys having their ends at a surface of the corresponding plate or at a surface of a further plate then covering the first plate of the layered structure assembly of the housing.

Thus, two separate channels may be provided, one channel system for supplying a fluid to a micro system and a second channel system for delivering a fluid from said micro system on an outlet side (e. g. a delivery side of said micro pump), said second channel system being circumferentially offset with respect to said first channel system and mounted in said plate-shaped layered structure element. Each of said channel systems leads away from a mounting position for said micro system, e. g. said pump, both in an axial and a radial outward direction to said connecting block for mounting said inlet and outlet connections, said mounting position being located far in the center of said housing construction. Preferably, said one further plate comprises a radial and an axial channel segment in said first channel system and in said second channel system. Therefore, in one single plate-shaped element, the fluid current may strongly be offset in a radial direction to allow the use of thicker connecting means, but nevertheless to provide a shaft in a shaft support on both sides of said support plate accommodating said micro system. Thus, the shaft opening extends on both sides of said support plate, and said shaft is supported on both sides of said micro system.

The micro pump is referred to as an example. The housing construction is similarly suited for accommodating other micro systems, such as a micro motor driven by a fluid, which micro motor is driven by supplying a fluid current, and in which micro motor a delivery shaft delivers at a speed corresponding to the fluid current. A sensor having a fluid drive may also be used as a micro system, said sensor being arranged in said housing construction and measuring a fluid current, a shaft not having to extend completely out of said housing, but only being provided as a shaft end for supporting a rotor, a speed corresponding to said fluid current being scanned by optical, inductive or magnetic means. Therefore, the proposed housing has a versatile field of application for practically all micro systems working with a fluid flow rate, said micro systems being represented according to the invention by a pump, a motor and a sensor.

Axial channel segments in an additional plate-shaped layered structure element arranged directly adjacent to said support plate for said micro system may have a particular design. When their length is smaller than a height (or thickness or size) of said layered structure element, said continuous axial kidney is coupled to be laterally offset, when the diameter of said axial channel segment is larger than a maximum width of said kidney at said coupling position. A total volume of said fluid collected in said continuous axial kidney may thus be delivered easily and without flow difficulties, a flow cross-section of an opening being recommended to be selected such that it substantially corresponds to a cross-section of said kidney at a position of a maximum flow volume, which cross-section in an operation mode is interspersed by said fluid to be conveyed through said channel segments.

A maximum flow volume (volume per time) exists on both sides (suction side/delivery side) of a pump or a motor and is not constant in case of a circumferentially extending kidney, which is due to the manner of volume change of a respective conveying chamber during a rotary movement. When the axial channel segment in the further plate-shaped layered structure element is provided at a circumferential position of said kidney, particularly continuously changing its width, the supplied fluid and the delivered fluid may be axially displaced exactly to a position at which said maximum flow volume is obtained in the course of said circumferentially extending kidney. In an axial top plan view of a pump rotating clockwise, said maximum flow volume is located in a first and a second quadrant, in said first quadrant at an angle between 75° and 85°, particularly substantially between 80° and 85° and correspondingly axially symmetrical in said second quadrant.

A design of a radially oriented, elongated opening through said further layered-structure element between said connecting block and said first further layered structure element comprising said kidneys is obtained by combining an axial and a substantially radial channel segment, said radial channel segment having a depth oriented in an axial direction, said depth corresponding to an axial extension of a second or further) layered structure element. Said channel segment provides a displacing function for said fluid current leading from portions close to an axis to radially more outward portions, where two adjacent connections for supplying and delivering a fluid may be arranged in said connecting block without problems.

According to the invention, slant openings or channel segments having a skew or slant orientation relative to an axis may be avoided in said layered elements. The channel segments according to the invention have a radial, circumferential or axial extension or an optional combination thereof, so that described by cylindrical coordinates, each position in said housing construction is within reach, combined by an axial channel segment, circumferential channel segment or radial channel segment respectively required. By selecting specific plates comprising corresponding channel segments, connections between standard components may be obtained without designing a whole micro system with its housing. Only layers of a layered structure construction, which layers have to be designed differently, are newly designed while maintaining the remaining layers.

The complete layered structure of said housing is axially tightened together, e. g. by center pins and/or cylinder screws inserted at an end part, at which also a mounting position is provided for a micro pump accommodated in said housing. On another axial side of said housing, connections for supplying and delivering a fluid are provided, said connections having either a radial or and axial orientation depending on the design of said connecting block.

The invention

- provides a fluid transition from connecting means having relatively large dimensions to a miniaturized fluidic operational range of a micro system, such as a micro pump;
- realizes a miniaturized manufacturing of toothed ring micro systems;
- provides a flexible fluid conveyance in a layer structure (from a connection to a rotor), which structure is easy to manufacture;
- provides a flexible design of a "connecting block" housing component for supporting different connecting means or fluid connections varying in their position;
- provides a representation of flow cross-sections in structures having a 2 1/2 dimensional extension, such as they may be provided for instance by LIGA, wire erosion, precision blanking, etching, laser, etc.;
- allows expendable parts, such as bearings, to be exchanged;
- allows a batch processing of a number of parts simultaneously;
- allows the use of an identical semi-finished product (basic material) for all operational ranges;
- allows a direct piling of a number of rotor sets.

A particularly favorable coupling embodiment for mounting a housing construction at a driving source, such as a feed-forward or feed-backward controlled drive, is realized by a coupling housing, on one side of which said housing construction with said micro pump and on the other side of which a drive assembly are mounted. Both said drive assembly and said housing construction for the micro pump are provided with a protruding collar, said collars preferably not having equal dimensions to avoid confusion of the different sides. Said collar engages in a recess exactly adapted to said collar, said two recesses in said coupling housing being exactly aligned in an axial direction relative to each other. When said pump and said drive assembly are mounted with their exactly fitting collars from both axial sides of said coupling housing, it can be guaranteed that the shafts are in an axial alignment and remain connected in said axial alignment over an adapter. Thereby, a radial offset of said shafts may be avoided; assembling is favored and accelerated. Said coupling housing may be covered by a sleeve having an outer polygonal, particularly a tetragonal or a octagonal design, from which sleeve a motor and a pump protrude on both face ends. Said coupling may also be used for other combinations of fluidic micro systems.

Thus, the invention provides clearness, easily manufacturable individual parts, facilitates manufacturing, and increases assembling flexibility and exactness. Only necessary layered structure elements have to be precision manufactured, whereas other, uncritical layered structure elements may remain as standard components. It is particularly pointed out that said layered structure elements, when they are plate-shaped, may preferably have an equal thickness (a height measured in an axial direction) and may therefore be manufactured as semi-finished products from the same plate material. The same semi-finished produce serves as a basic product for a number of layered structure elements which are arranged axially one after the other and all have equal quality features of the basic plate. A different evenness and surface quality of said basic plate is thus transferred directly to the layered structure elements manufactured from said plate and predetermine which semi-finished product should be used for which precision parts and which other semi-finished product should be used for the standard elements of the layered structure. Therefore, manufacturing costs may be reduced, an after-treatment of said precision parts being avoided and a semi-finished product involving a high cost not having to be used for all layered structure elements, which avoided methods would have resulted in an increase in the cost of the manufactured housing construction. In addition to said cost reduction, an exact fluid conveyance in said micro pump and a sealing between the individual layered structure elements as well as an exact fluid conveyance in said inlet kidneys, said outlet kidneys and said compensating kidneys are provided, said features determining the performance and the efficiency of said micro pump.

An elongated axial opening is called "shaft opening" for supporting said shaft, when mounting a micro system. Said opening is elongated, it extends continuously through a support plate and in both axial directions of said housing construction, said opening extending at least through said further plate-shaped layered structure, said support plate and said connecting block or said base element, at least reaching into to extend "continuously". Two layered structure elements with their shaft opening portion, may serve as bearings for said shaft with a slide bearing, said elements being directly adjacent to said support plate (for said micro system). Depending on the length of said axis, an additional bearing may be provided in said base element, said bearing being designed as a rolling bearing or a slide bearing, for additionally supporting said shaft in a portion located between said supply side and said delivery side (in case of a pump and a motor or in case of a fluidic motor and a drive). Said shaft may thus be stabilized in said slide bearings, thereby increasing the service life of said bearings. In said connecting block, a shaft safety device may be provided, said device blocking an axial movement of said shaft. Said safety device is not required, when said additional bearing in said base element is provided; in this case, said shaft is not required to protrude into said connecting block, but it may terminate before, which is correspondingly valid for the shaft opening of the housing.

The above used terms of an extension in an axial direction, in a radial direction and in a circumferential direction are oriented at cylindrical coordinates, however, a plate-shaped layered structure assembly has not necessarily a cylindrical outer shape, on the contrary, also a polygonal, such as a tetragonal, a hexagonal or an octagonal outer shape, as well as not circular shapes, such as oval shapes, are comprised by the invention. Also a radial extension has to be regarded as only substantially radial. The use of the technical term "circumferential" extension serves to facilitate comprehension, but not to restrict the realization of the invention. In the same manner, the terms "disc" and "plate" are used such that they describe a flat shape without a specifically defined outer dimension or outer shape, although it is advantageous to select a cylindrical shape being oriented at the cylindrical shape of said outer wheel of the micro pump, however this is not imperative.

BRIEF DESCRIPTION OF THE DRAWING

In the drawing:

Figure 1 is an exploded view of an embodiment of the invention, illustrating a micro pump MP centrally accommodated in a housing, said micro pump being supported by a number of layered structure elements which are represented here as cylindrical discs.

Figure 2:
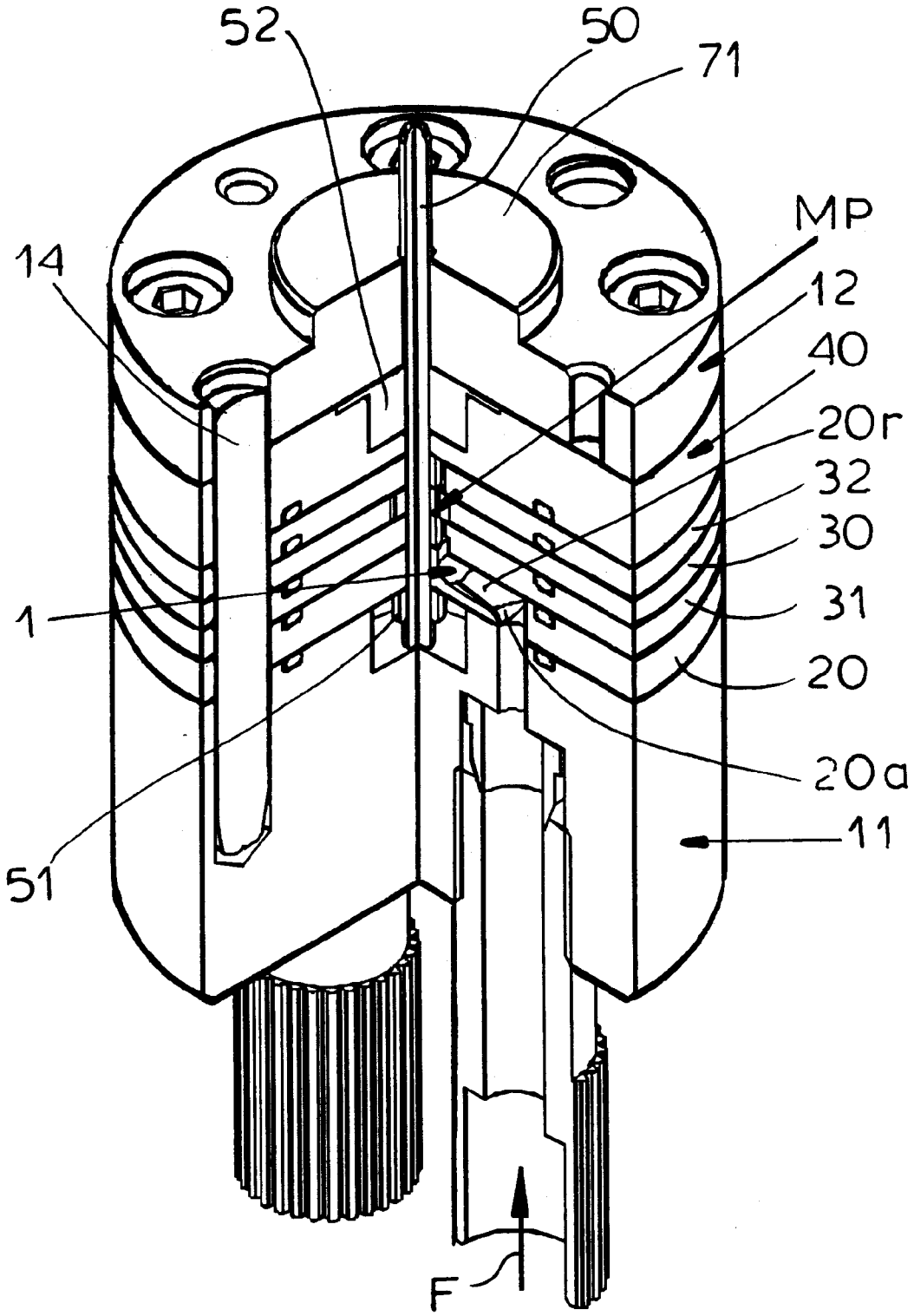
FIG. 2 illustrates the embodiment of FIG. 1 in an assembled state, assembling screws 13 and center pins 14 passing through said layered structure assembly and being tightened, and a quarter section permitting a view into said layered structure and said micro system MP.

Figure 2 illustrates the embodiment of Fig. 1 in an assembled state, assembling screws 13 and center pins 14 passing through said layered structure assembly and being tightened, and a quarter section permitting a view into said layered structure and said micro system MP.

Figure 2a is an illustration similar to that of Fig. 2 showing that embodiment, the micro pump in the center of said housing being visible more clearly.

Figure 3:
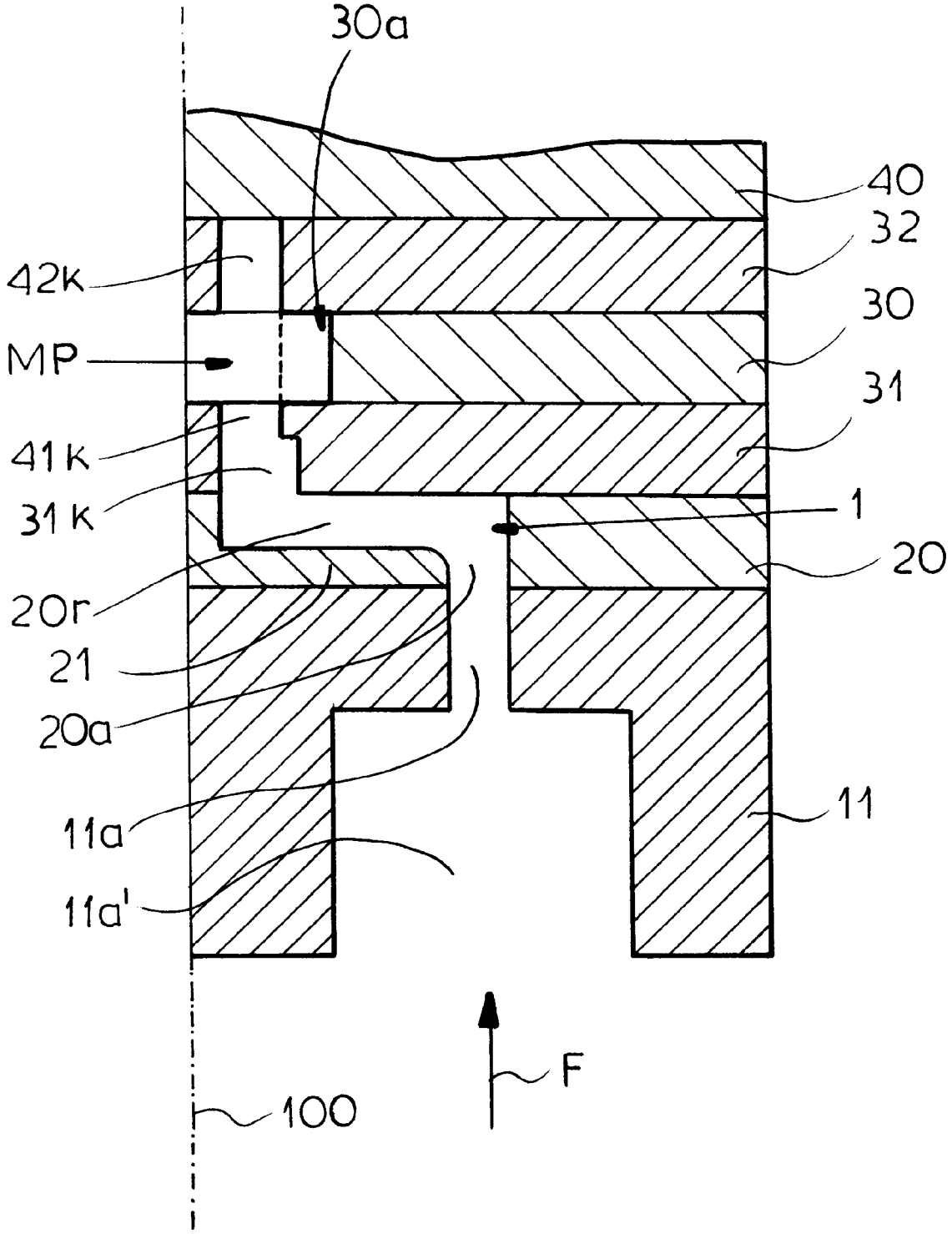
FIG. 3 is a schematic illustration of channel segments being lined up for providing a channel system 1, said figure only showing an inlet on a suction side of said micro pump MP, illustrated by a fluid F to be supplied.

Figure 3 is a schematic illustration of channel segments being lined up for providing a channel system 1, said figure only showing an inlet on a suction side of said micro pump MP, illustrated by a fluid F to be supplied.

Figure 4:
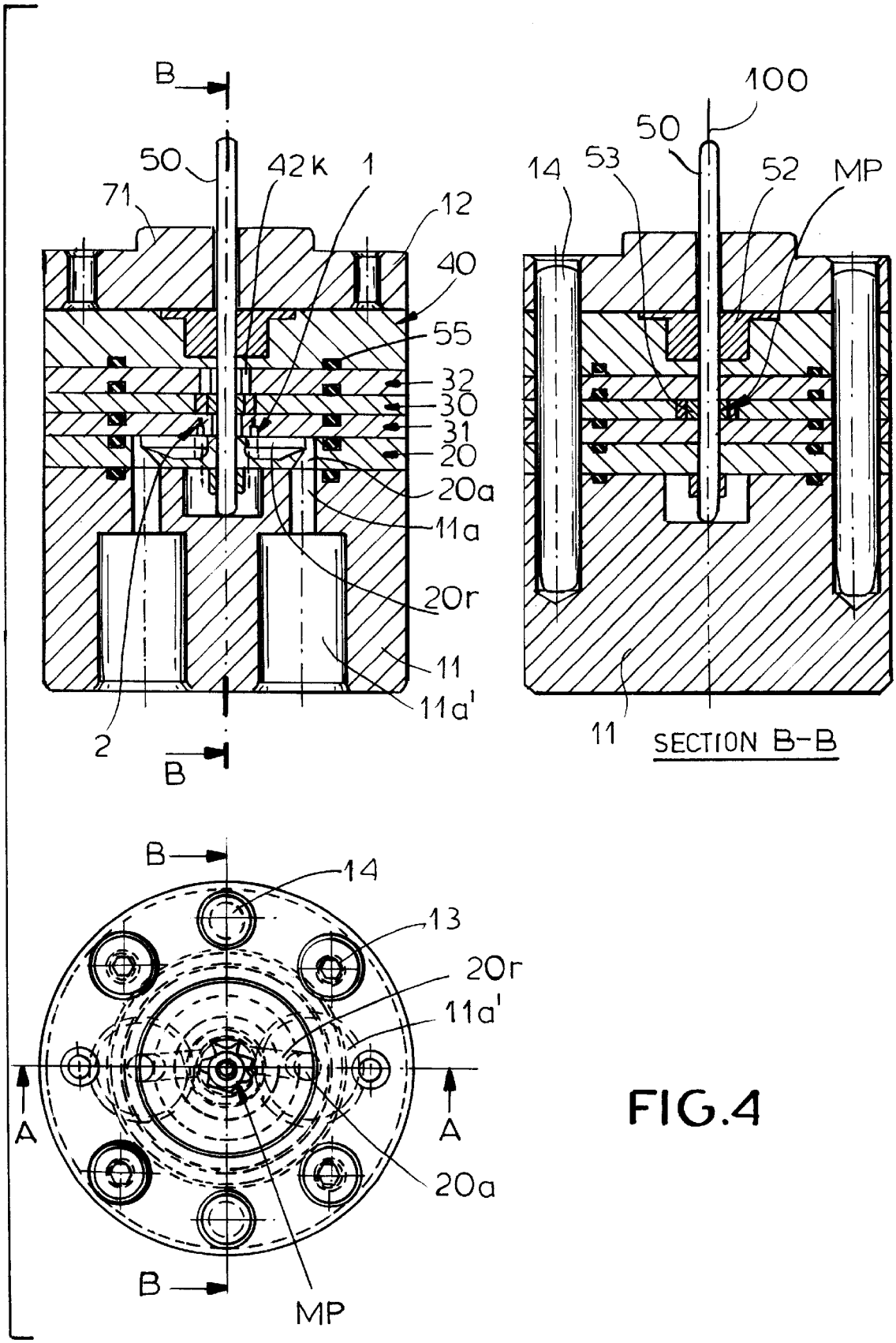
FIG. 4 comprises three individual illustrations showing a top plan view, a section A—A and B—B. In this figure, the fluid conveyance is also visible, channel segments being lined up according to FIG. 3, only in a section A—A on both sides of a center plane B—B.

Figure 4 comprises three individual illustrations showing a top plan view, a section A-A and B-B. In this figure, the fluid conveyance is also visible, channel segments being lined up according to figure 3, only in a section A-A on both sides of a center plane B-B.

Figure 5:
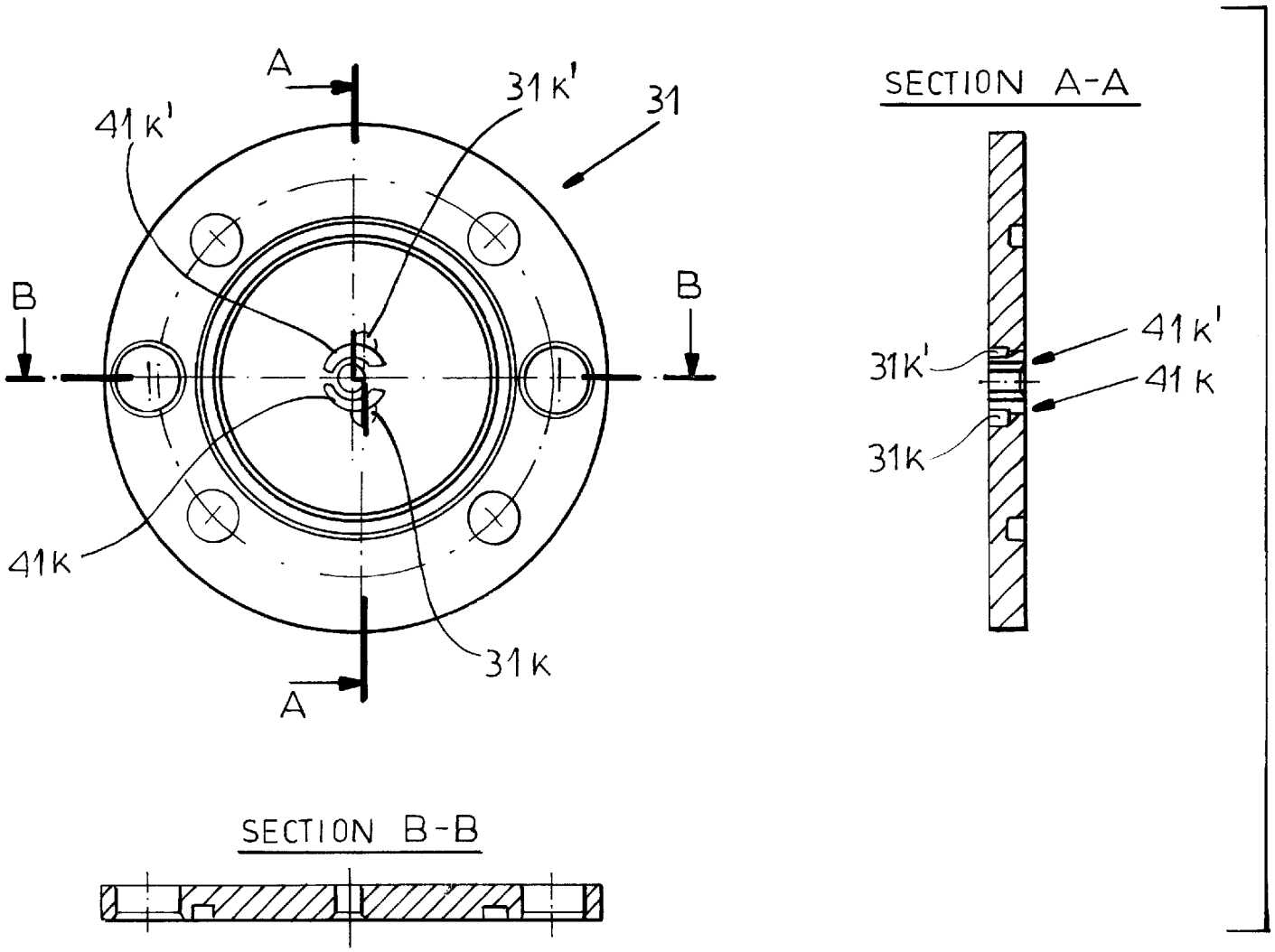
FIG. 5 illustrates a layered structure element 31 in this embodiment having a cylindrical shape and being provided with kidney-shaped channel segments and with axial openings.

Figure 5 illustrates a layered structure element 31 in this embodiment having a cylindrical shape and being provided with kidney-shaped channel segments and with axial openings.

Figure 5B:
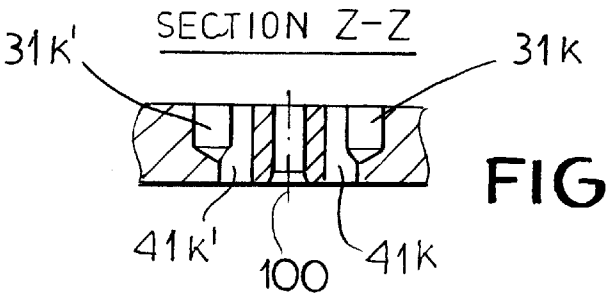
FIG. 5*b* are enlarged partial views of FIG. 5, relating to the shape and the arrangement as well as the alignment of said kidneys and axial openings.

Figure 5a,

Figure 5b are enlarged partial views of figure 5, relating to the shape and the arrangement as well as the alignment of said kidneys and axial openings.

Figure 6:
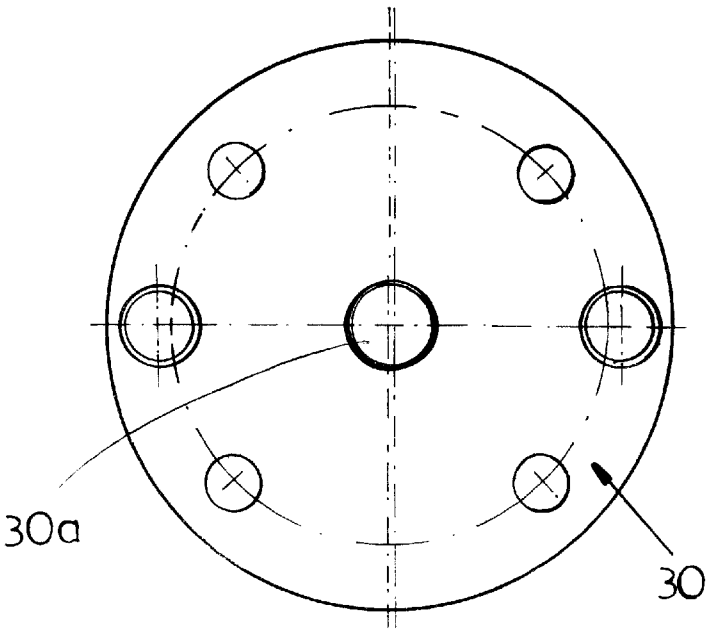
FIG. 6 illustrates a support plate 30 for supporting said micro pump in an eccentrically arranged cylindrical opening 30*a* provided in a center portion.

Figure 6 illustrates a support plate 30 for supporting said micro pump in an eccentrically arranged cylindrical opening 30a provided in a center portion.

Figure 7:
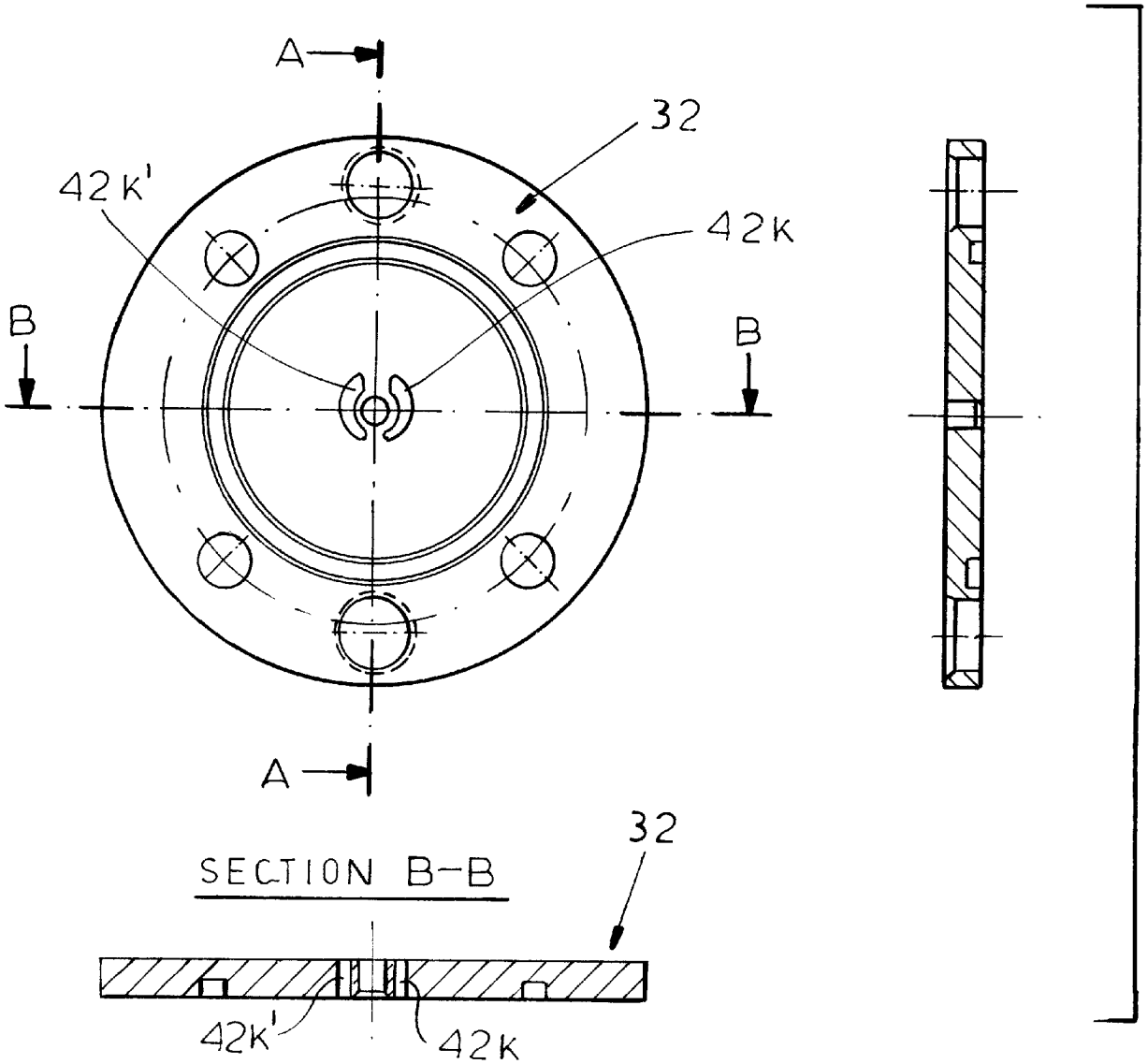
FIG. 7 comprises a top plan view and two sectional views from the planes A—A and B—B, illustrating an embodiment of an "additional" plate-shaped layered structure element 32 being arranged on the other side of said support plate 30 for the micro pump according to FIG. 6, whereas the embodiment according to FIG. 5 of a "further" plate-shaped layered structure element 31 has to be arranged on a first side.

Figure 7 comprises a top plan view and two sectional views from the planes A-A and B-B, illustrating an embodiment of an "additional" plate-shaped layered structure element 32 being arranged on the other side of said support plate 30 for the micro pump according to figure 6, whereas the embodiment according to figure 5 of a "further" plate-shaped layered structure element 31 has to be arranged on a first side.

Figure 8:
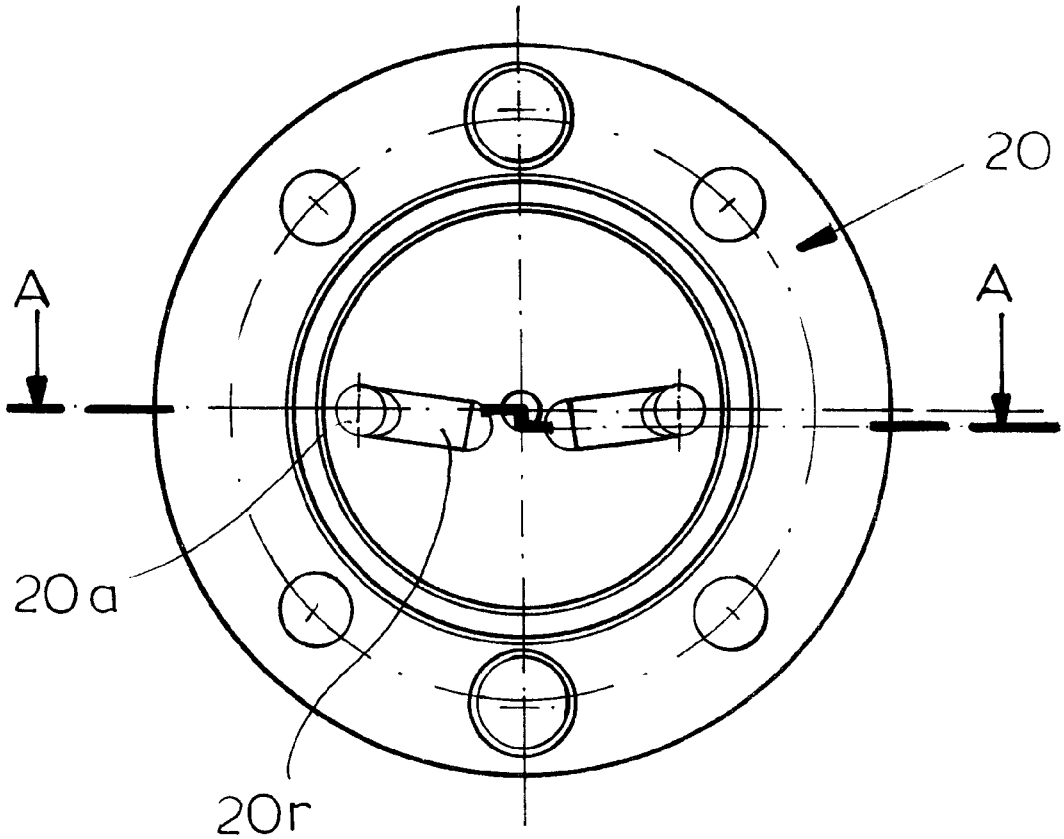
FIG. 8 is a top plan view and a sectional view of a further plate element 20, in which fluid conveying radial and axial segments 20*a*, 20*r* are arranged.
Figure 8:
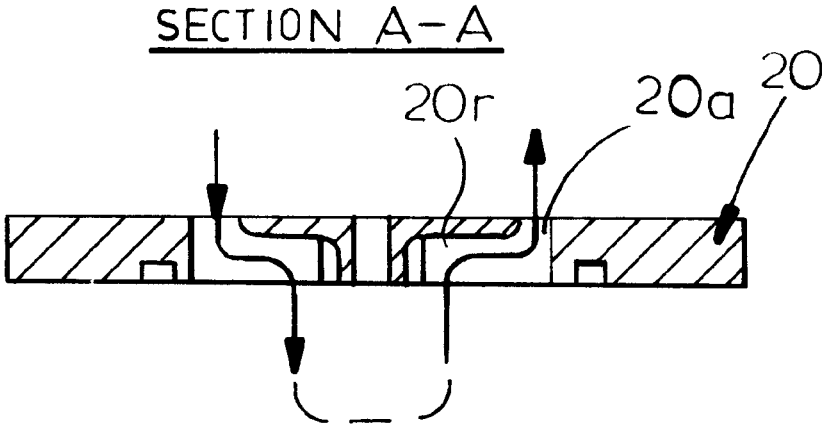

Figure 8 is a top plan view and a sectional view of a further plate element 20, in which fluid conveying radial and axial segments 20a, 20r are arranged.

Figure 9:
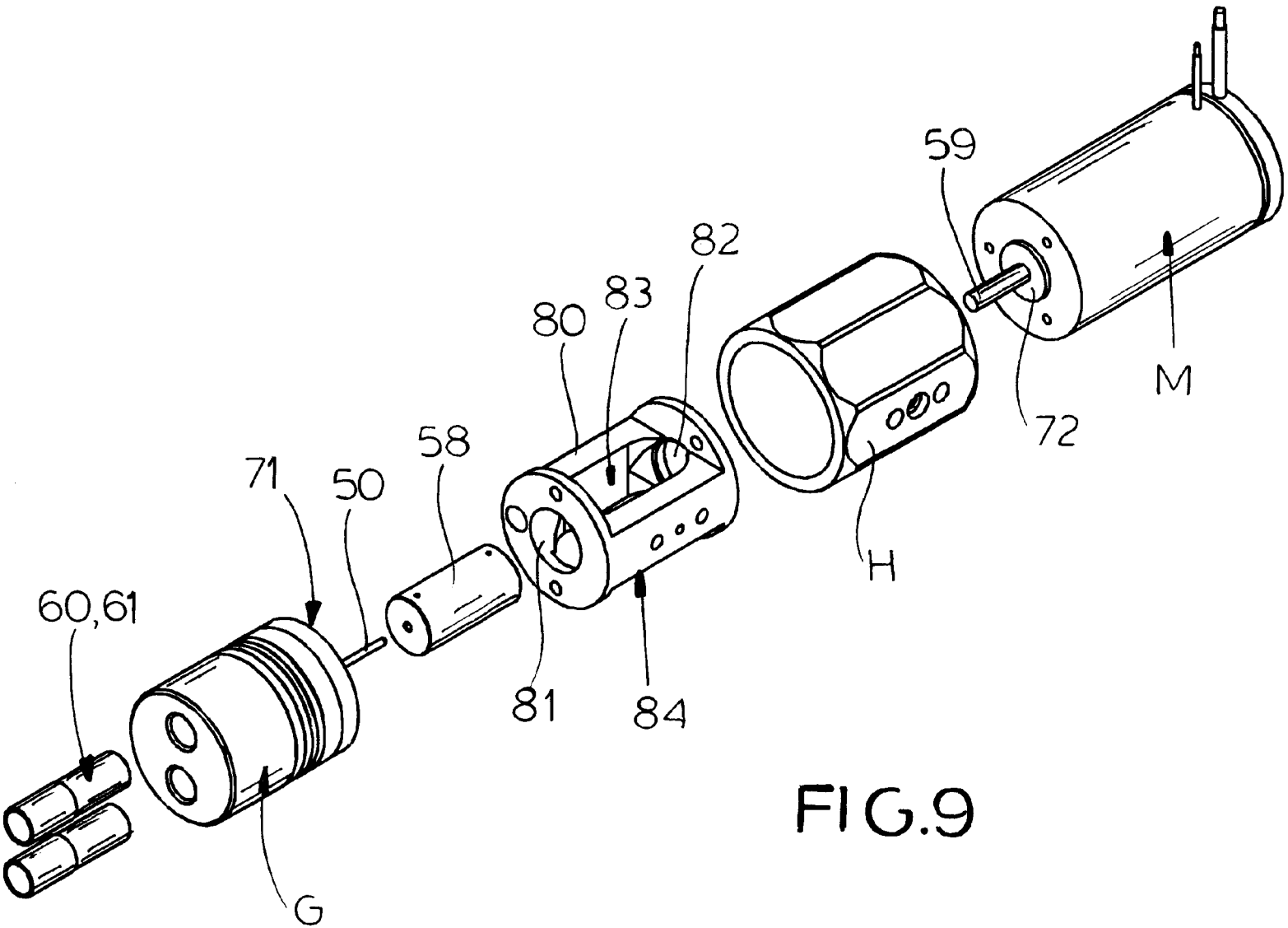
FIG. 9 illustrates an embodiment of a pump mounted over a coupling part 80 at a motor M.

Figure 9 illustrates an embodiment of a pump mounted over a coupling part 80 at a motor M.

SPECIFIC DESCRIPTION

It is pointed out that the terms of an additional layered structure element and of a further (first and second further) layered structure element are used uniformly. A basic layered structure element defining a concept is a support plate for receiving or accommodating a micro system as an inner plate, and a connecting block 11 on one side and a plate-shaped base element 12 on the other side. Said connecting block and said plate-shaped base element are not required to be directly plate-shaped, they may also be designed individually longer in an axial direction, to form unilateral or bilateral block structures.

Between a support plate 30 of figure 1 and a connecting block 11, two "further" plate structures 20,31 are provided. Between said support plate 30 and a plate shaped base element 12 of figure 1 two "additional" plate-shaped elements 32,40 are provided which elements realize respective independent functions. Said "further" plates shall be oriented uniformly to a side on which said connecting block 11 is located; said "additional" plates shall be oriented uniformly terminologically to a side directing to said plate-shaped base element 12.

A micro system, which in the following embodiment is designated as a micro pump MP, has a structure schematically illustrated in figure 1 and comprising an outer wheel A and an inner wheel I, said inner wheel with its teeth protruding in an outward direction being in a meshing engagement with said outer wheel A which is also rotatably supported in an opening 30a of said center plate 30. A rotary movement is transferred to said inner wheel I over a shaft 50, said shaft being fixedly coupled to said inner wheel I by a short, axially oriented pin 53, in the sense of a shaft/hub connection. Said micro pump is explained in detail in the above described WO-document, an outer wheel 30 and an inner wheel 20 being continuously designated similar to said outer wheel A and said inner wheel I according to the invention. Said system is an embodiment of providing optional micro systems at an inside of a housing construction comprising a number of layered structure elements 11,20,31,30,32,40,12 and illustrated in figure 2a and figure 2. Other embodiments of micro systems are micro motors, which have a similar construction as the micro pump of figure 1. A meshing sensor or a rotary disk valve at the inside of said housing at a position of said opening 30a may also be implemented. An outer gear pump may also be used which is arranged either over a shaft or directly loosely in a correspondingly designed elongated oval opening in which two outer wheels which are in a meshing engagement, are supported as a first and a second functional component of a fluidic micro system.

The inventive embodiment is very obvious, when regarding figures 1,2,2a and 3 in combination. The exploded view of figure 1 shows two layered structures which are described first, a connecting block 11 and a base element 12, said base element having a substantially plate-shaped design. In the middle between said two components, an already mentioned support plate 30 with an opening 30a adapted to the micro system is located, said opening being prepared for eccentrically supporting an outer wheel A relative to a housing axis 100 constituted by a shaft 50. Between said support plate 30 and said connecting block 11 for fluid supply means, mostly flexible plastic tubes 60 comprising corresponding fitting means for being fixed in support openings 11a', two further plate-shaped discs 20 and 31 are provided, each comprising a center opening for accommodating said shaft 50. On a side between said support plate 30 and said base element 12 comprising fixing means 13,14 for axially tightening together and fixing said layered structure elements, two additional plate-shaped layered structure elements 32,40 are provided which also have a center opening for accommodating said shaft. Said shaft protrudes out of said tightened housing according to figure 2a (which is illustrated axially symmetrical with respect to figure 1) on a side on which said plate-shaped base element 12 is provided, for flanging a drive to said protruding shaft end, said flanging being effected over a hat-shaped elevation 71 according to figure 9, which will be described later, on the other side, said shaft does not protrude.

The individual functional elements of figure 1 are illustrated in figure 2a in a tightened state. In this figure, said micro pump MP is only schematically visible, as also in figure 2, however, the layered structure assembly with the fluid conveying means from said tubes 60 to said micro system is distinctly visible, said assembly being illustrated schematically in a sectional considerably enlarged illustration according to figure 3.

Figure 3 shows the same layered structure elements which were explained in figure 1. A channel 1 extends over channel segments 11a,20a,20r,31a and 41k to said micro pump MP, and on an axially symmetrical side opposite of said axis 100 not shown in figure 3, said channel extends back from said micro pump MP to an outlet of said housing.

Said connecting block 11 serves for accommodating fluid supply means and for fixing flexible tubes. Said tubes are fixed in a cylindrical support opening 11a' by sleeves and clamping elements, mostly ferrules, and sealed at a face end. From said support opening which has a considerably larger diameter, a connecting opening 11, which is by a multiple smaller in diameter, leads to a face end of said connecting block 11. Figure 3 illustrates said fluid channel schematically.

Said connecting block 11 is followed by a fluid guiding and conveying further plate-shaped layered structure component, comprising a firstly axially extending channel segment 20a according to figure 3 and figure 2. Said axial channel segment 20a turns into a radially extending channel segment 20r to subsequently extend again in an axial direction, which is achieved automatically, when said radial segment is mounted directly on a face end opposite of said inlet of said further layered component 20. By said axial, radial and again axial channel, said fluid is deviated and a closer approach of said fluid towards said shaft is permitted, where said micro pump MP is arranged in said opening 30a for receiving said fluid. Said axial/radial channel extension may also be realized in said plate-shaped layered structure element 20 by continuously providing an oblong hole, taking over both said axial component and said radially oriented fluid guiding. In this case, no residual web 21 remains, as still indicated in figure 3, which residual web results from said radial channel segment 20r not having a depth equal to a height of said further plate segment 20 in an axial direction.

On a face end of said plate-shaped element 20, said face end being opposite of said fluid supply side, a second further plate-shaped element 31 representing a "kidney plate" is arranged, in which kidney plate said fluid is both axially guided and circumferentially guided in a kidney and distributed over a circumferential portion of said outer and said inner wheel A/I of said micro system. Said kidney 41k and an axial opening 31k are described further below in figures 6 and 7, which sectional enlarged views illustrate the orientation, size and shape of said kidneys 41k as well as of said axial channel segment 31k.

On a surface of said second further plate 31, said surface being opposite of said fluid supply side, an already described support plate 30 comprising an inner opening 30a is arranged eccentrically with respect to an axis 100. At said position, said micro pump MP comprising an outer wheel A is rotatably supported, and said fluid F reaches a number of conveying chambers of said meshing wheels A,I on a suction side over said circumferential kidney 41k.

For achieving a hydraulic balance, equally oriented and designed kidneys 42k are arranged in an additional plate 32, said kidneys being oriented opposite of said first described kidneys 41k. Said second "kidney plate" 32 is directly adjacent to said support plate 30 for said micro system MP. Thus, said second kidney plate comprises channel segments circumferentially oriented with said compensating kidneys 42k. In said channel segments, fluid is not delivered in an axial direction. On the contrary, after displacing said conveying chambers of said micro pump MP to a delivery side, said fluid current returns to the other side of a center plane of said housing construction, which other side is not illustrated in figure 3, but is easily imaginable to be reflected axially symmetrical, for conveying said fluid F in the same manner from said micro pump MP to an outlet and a corresponding flexible tube 60. In said first further layered plate 20, said fluid is also considerably displaced in a radial direction so that it is conveyed in an outward direction away from said shaft, for fixing the connections in said connecting block 11 without spatial difficulties.

A layered structure element 40, directly adjacent to said second kidney plate 32 does not comprise channels, but it serves for supporting said shaft by a shaft sealing 53 visible in figure 1.

Said second additional plate 40 is followed by said already described base element 12 which is adapted to tighten said entire housing in an axial direction and to offer assembling means according to figure 2 in the form of a cylindrical collar 71, for flanging a motor to a pump, and for driving a corresponding pump with a fluidic micro motor in an inverse operation mode on the other side of said housing construction.

The support of said shaft is also visible on figures 1, 2 and 2a. A torsion-proof locking means is provided by a pin 53, engaging in a corresponding opening of said inner wheel 1 upon being mounted. For being precisely aligned, said shaft 50 is guided in two center openings of said plates 31 and 32 which are arranged directly adjacent to said support plate 30. Said further and said additional plates outside of said plate elements arranged close to said plate 30 and taking over a bearing function, have a larger clearance with regard to the opening for said shaft. In said connecting block 11, an axial shaft safety device 51 may be provided, said device preventing an axial displacement of said shaft 50. On the other side of said support plate 30, a shaft sealing 52 is provided, sealing the inside of said pump against the environment and providing a hydraulic balance for said shaft. Thus, no axially directed forces act on said shaft, said shaft being in a hydrostatic balance. When an additional bearing is provided in said base element, said shaft safety device 51 and an engagement of said shaft in said connecting block are dispensable.

Said inner layered assembly plates 31,30 and 32 are precision manufactured, they have a high surface quality and a high exactness concerning both said shaft support 50 and said wheel support A. The plates of said layered structure which are located further outward are not required to have such a high precision as said inner elements. On the contrary, they are applicable as standard components and may be manufactured from semi-finished products of an inferior quality. Preferably, two different semi-finished products are used for manufacturing said plate-shaped layered structures according to figure 1; semi-finished products of a superior quality with regard to surface quality, evenness and flatness are used for precision plates, and semi-finished products of a just sufficient surface quality are used for the remaining plate-shaped elements of the entire layered structure.

Thus, the manufacturing process is advantageously facilitated and reduced in cost.

The remaining figures are in a close connection with the above described constructive features, therefore, in the following figures, the individual layers of the entire layered structure assembly are described.

By using equal reference numerals figure 4 describes the elements explained in figure 1 in an axial section A-A and in an axial section B-B offset at an angle of 90° relative to said section A-A as well as in a top plan view from an axial side which protrudes from said shaft 50.

Pins 14 keep said assembly centered and aligned. At an angle of 90°, openings for cylindrical screws 13 are provided, for tightening together said layer arrangement, which is aligned by said pins 14.

In said section A-A, both channel systems 1,2 are visible, said channel systems being arranged circumferentially offset in said layered structure elements. They are not required to be reflected axially symmetrical, but according to the top plan view of figure 4, they may be angled at 180° with respect to each other. On a connecting side in said connecting block 11, a sufficiently dimensioned distance shall be provided between blind holes 11a' for accommodating flexible tubes and their fixing sleeves, whereas in said micro system MP, said fluid current is required as closely as possible to said shaft 50. A radial extension of said micro system is only small, and a displacement of a fluid generating means or a fluid consuming means or a fluid sensor, depending on the application, which elements are located close to said axis 50, towards said connecting block, is achieved by said further plate 20 with channel segments displaced substantially radially outward, said plate not comprising kidneys for an inlet and an outlet current of said micro system, but only serving for guiding and deviating a fluid, particularly in a radial direction.

Said radial fluid deviation with said channel segment 20r is visible from both said top plan view (marked by broken lines) and from said sectional view B-B. Said deviation is located between an axial part 20a, directly adjacent to a extended channel portion 11a of a smaller diameter, said extended portion starting out from a support opening 11a'. Said radial channel segment 20r turns into an axial opening in the subsequent layered plate 31, said opening being offset with respect to the subsequent kidney, which shall be described on the basis of figure 5. Before, the distinct illustration of said non-rotatable locking by a pin 53 according to the sectional view B-B is to be mentioned, from which illustration both said shaft sealing 52 and said axial shaft safety device 51 in said plate-shaped layered structure are visible; said connecting block 11 is provided with a center recess for an end provided with said shaft safety device. All plates are sealed by O-rings 55 with respect to the subsequent plate, an annular groove being provided at a face end of at least one of the plates contacting each other.

Figure 5A:
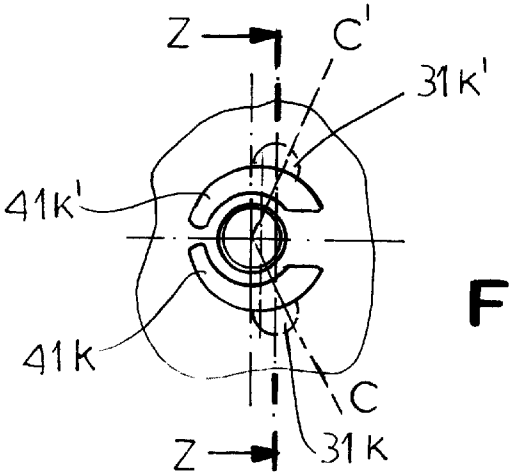
FIG. 5*a,*

Figure 5 comprises a top plan view and two sectional views A-A and B-B. Selective enlargements of the center portion of figure 5 are shown in figure 5a, and a section thereof along a line Z-Z in figure 5b.

Figure 5 illustrates a first kidney plate 31, said kidney plate being located between said first further plate 20 an said support plate 30, for orientation purposes used as a center of the explanation. Said "further" plate 31 is in direct contact with said support plate 30 for the micro system. Figures 5a,5b illustrate the position, the orientation and the size of said kidneys 41k,41k' and of axial inlet openings 31k,31k', which turn into said kidneys offset in a radial direction at a predetermined position along a circumferential extension of said kidneys.

Figure 5 shows said two kidneys 41k,41k' extending at an angle of slightly less than 180° and being reflected axially symmetrical with respect to said center plane B-B. In a first and second quadrant (oriented counter-clockwise) of said top plan view, said supply opening 31k and said delivery opening 31k' are located, said delivery opening delivering said fluid after a U-shaped deviation by said micro system - which is not shown here.

The enlargement of figure 5b shows that the center opening serves for supporting said shaft 50. Regarded in a direction of rotation (supposed to be clockwise), said kidneys 41k and 41k' enlarge on a suction side - of said pump - in a radial direction to decrease again from a larger width to a small width on the delivery side - of said pump - in said direction of rotation. The kidneys have such an axial depth that they extend through the entire plate 31, thus providing axial channels, simultaneously providing circumferentially oriented channels. In an axial direction, a cross-section for supplying and delivering a fluid is increased by providing an additional opening 31k,31k' having a larger diameter than a radial width of the kidney at a position at which said opening touches or intersects with said kidney. Two radial vectors C and C' illustrate an angle orientation relative to a center plane B-B; it is in the range between 75° and 85° in said first and said second quadrant.

At the described coupling positions to said kidneys, portions of a maximum flow volume of a micro system in operation are located, concerning both the supply and the delivery of fluid, said maximum flow volume resulting from increasing and decreasing of the volume chambers upon rotation. Axial openings additionally enlarging a delivery cross-section and a supply cross-section are located exactly at a position at which said maximum flow volume is realized in an operation mode, said openings not extending completely continuously through said plate 31, but being provided as applied blind holes.

In a manufacturing process, firstly said blind hole 31k or 31k' is applied and subsequently the shape of said kidney 41k,41k' is added by an erosion method, so that a combined axially enlarged supply channel with a circumferentially oriented kidney volume is obtained. Figure 5b clearly shows said orientation along a section Z-Z shown in figure 5a.

Figure 7 illustrates an additional plate 32 located on another side of said support plate 30 with eccentric opening 30a of figure 6. For a direct comparison with figure 5 in a top plan view, said axes A-A and B-B have to be rotated by 90°, so that said kidneys are directly congruent. This embodiment relates to compensating kidneys 42k' and 42k. Said compensating kidneys are located directly opposite to said supply and delivery kidneys 41k and 41k'. The are equal in shape and circumferential extension and extend completely through said additional plate 32 in an axial direction, thus providing both an axial channel segment and a circumferential channel segment. However, said axial channel segment terminates at the surface of said additional plate 32.

Said first further plate 20, which had been explained in detail on figure 4, is shown in a top plan view and in a sectional view A-A on figure 8 for additional illustration. Said sectional view shows the flow path of said fluid F with a U-shaped deviation of said micro system indicated by a broken line. Each of said fluid conveying, combined channel segments comprises at least an axial segment 20a and a radial segment 20r. Said radial segments may be slightly inclined in a circumferential direction, as visible from said top plan view. According to a particularly favorable manufacturing method, said radial segments may be oblong openings completely milled or manufactured by erosive burning (wire erosion), said openings realizing both an axial fluid supply 20a and a radial fluid deviation following said oblong hole.

Said construction, which was descriptively explained above, is schematically shown on figure 9 as a complete assembly representing a housing construction G to which connections 60,61 lead. Said shaft 50 protrudes in a direction of a motor M to be flanged to said shaft, said motor comprising a shaft journal 59. A coupling of said two shaft journals without a radial displacement and in an exact axial alignment, is effected by a coupling means 80 comprising a precisely defined opening 81,82 on both face ends, said openings mostly being precision manufactured to have a round shape. A respective collar 71,72 is arranged at a face end of said housing G for said micro system and at a face end of said motor M to fit exactly in said openings 81,82. Said cylindrical openings 81,82 are exactly aligned with respect to each other, and when said two functional elements M,G are inserted in said openings, said axes 59,50 are in alignment. Before said insertion, a shaft connecting means 58 is applied, which at first is loosely put on said shaft end 50, for subsequently being moved into said opening 81 together with said shaft end until said collar 71 is in a close contact at said housing construction G in said opening 81. Said motor M is mounted from the other side, said collar 72 being similarly fitted in said opening 82. Subsequently, said shafts 50 and 59 are fixed at said shaft connecting means 58, so that a drive connection is obtained which has a centered orientation without radial offset. An additional cover H may be put over said coupling means 80 as a sleeve with a possibly soft edge (chamfered) polygonal outer surface, so that a structure is obtained comprising at a center position a connecting means with a polygonal outer shape, a first functional element G on the left and a second functional element on the right. Said motor M and said pump housing G may also be exchanged, and two housing assemblies G may be flanged to each other, one of said assemblies accommodating a fluidic motor and the other a fluidic pump. A cascade is possible.

In figure 9, said housing construction G is provided with an outer surface having a cylindrical shape. A polygonal outer surface may also be provided, which comprises substantially uniformly extending side surfaces also in an axial direction for not having axially directed steps.

For securing against confusion, said cylindrical openings 81,82 described in figure 9 may have different diameters, adapted to said collars 72,71 of said functional elements G,M determined for them.

As far as said coupling means 80 is concerned, it is mentioned that said means comprises a hollow passage between the face ends, said passage being additionally accessible from laterally outside by two openings 83,84 having a secant-shaped axially symmetrical extension.

With respect to manufacturing engineering it is mentioned that said plate-shaped layered structure of figure 2 does not only show plates of equal strength (equal thickness), however, it would be advantageous to manufacture all plates from an equal layer thickness. Figure 3 schematically illustrates that a channel extending through said plates of substantially equal thickness, has a substantially equal cross-section along its extension for avoiding clearance volumes or dead fluid volumes.